US005215209A

United States Patent [19]

Radtke

[11] Patent Number: 5,215,209

[45] Date of Patent: Jun. 1, 1993

[54] MOUNTING CUP FOR PRESSURE FILLING

[75] Inventor: Charles S. Radtke, Little Ferry, N.J.

[73] Assignee: Precision Valve Corporation, Yonkers, N.Y.

[21] Appl. No.: 955,641

[22] Filed: Oct. 2, 1992

[51] Int. Cl.[5] ..... B65D 25/00

[52] U.S. Cl. ..... 220/619; 220/614; 222/402.1

[58] Field of Search ..... 220/619, 614, 601, 254, 220/465; 222/402.1

[56] References Cited

U.S. PATENT DOCUMENTS

| | | | |
|---|---|---|---|
| 2,775,483 | 12/1956 | Treharne, Jr. et al. | 220/619 X |
| 3,342,381 | 9/1967 | Simons et al. | 220/614 X |
| 3,627,179 | 12/1971 | Scheindel | 222/402.1 |
| 4,621,964 | 11/1986 | Radtke et al. | 220/614 X |
| 4,940,170 | 7/1990 | Popp-Ginsbach | 222/402.1 |
| 4,971,224 | 11/1990 | Scremin | 222/402.1 X |
| 5,014,887 | 5/1991 | Kopp | 222/402.1 |
| 5,016,785 | 5/1991 | Greenebaum, II | 222/402.1 |

*Primary Examiner*—Steven M. Pollard
*Attorney, Agent, or Firm*—Davis Hoxie Faithfull & Hapgood

[57] ABSTRACT

A mounting cup for closing an aerosol container is strengthened by configuring the terminal end of the profile portion of the mounting cup contiguous to the body portion of the mounting cup with an "S"-like shaped segment. The "S"-like shaped segment comprises a section contiguous to the body portion and a section distal to the body portion. The contiguous section is disposed a greater distance from the top of the body portion than the distal section, creating a panel depth in the "S"-like shaped segment contiguous to the body portion.

11 Claims, 2 Drawing Sheets

FIG. 4
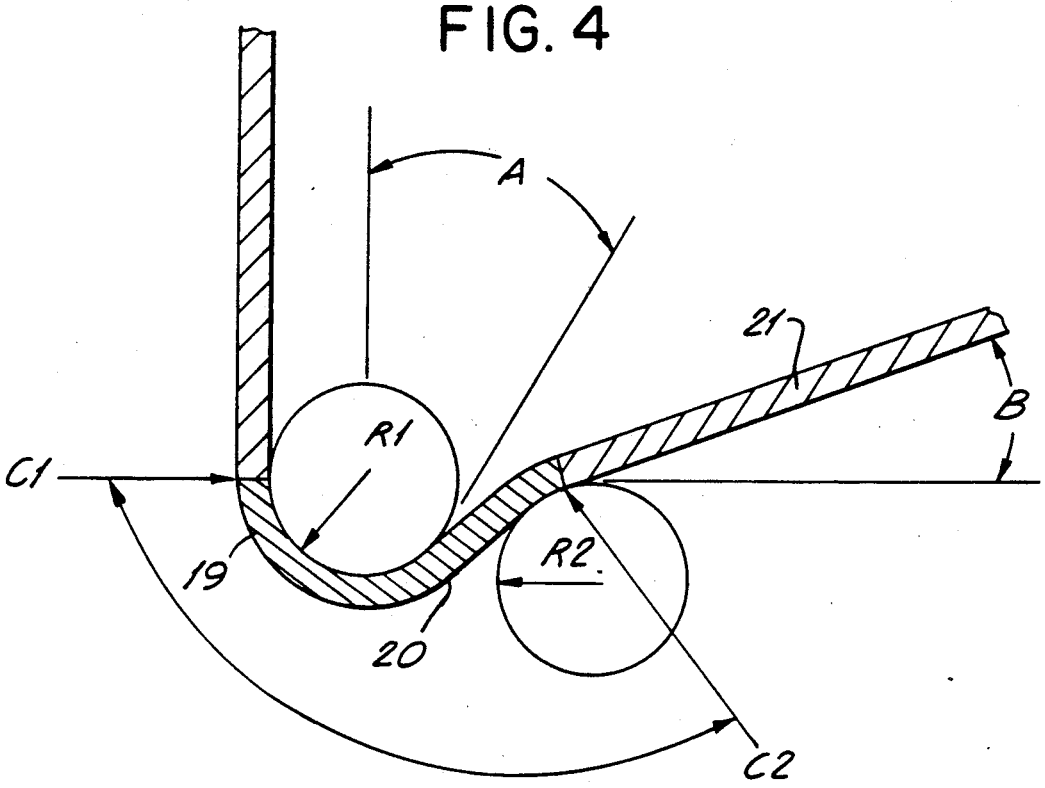
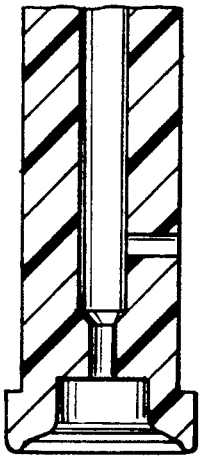
FIG. 5
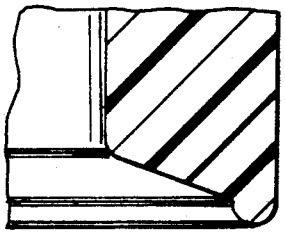
FIG. 6
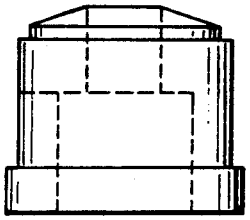
FIG. 7

MOUNTING CUP FOR PRESSURE FILLING

BACKGROUND OF THE INVENTION

The present invention relates generally to aerosol mounting cup closures having a valve staked into the pedestal portion thereof and, more particularly, to an improved mounting cup closure for an aerosol container.

In the filling of an aerosol container with propellant there are generally two systems employed. In one system, propellant is introduced into the container by passing the propellant under pressure between the bead of the container and the underside of the valve-bearing mounting cup closure. This system is commonly referred to as "under-the-cap" filling. In a single operation, the cup is lifted to create the filling space between the cup and the container bead and subsequently, after entry of the propellant, the mounting cup is crimped and sealed to the container bead. In a second system, the valve-bearing mounting cup is crimped and sealed to the container bead prior to the introduction of the propellant and the propellant is then introduced to the container by passing the propellant simultaneously through the valve and around the valve between the underside of the skirt of the mounting cup and the upper surface of the gasket obturating the valve stem orifice; this second system being commonly referred to as "pressure filling".

In pressure filling an aerosol container, a propellant filling head is advanced to a sealing position against the pedestal portion of the mounting cup. To generate a seal on the upper face of the pedestal and to withstand the force against the mounting cup and the concomitant breaking of the pedestal - filling head seal, an appropriate offsetting force must be applied against the force created by the advancing filling head. The stress on the mounting cup to unseat the filling head must be resisted so as to maintain the filling head - pedestal seal. If the seal is disengaged, propellant will flow, undesirably, external to the container.

Obviously, the disengagement of the seal between mounting cup and filling head during filling can result in economic disadvantages through the unwanted loss of propellant. Other economic losses attributable to the failed seal are also obvious; namely, the destruction of the valve and the need to remove the container bearing the product to be dispensed from the filling line. Because of the very large market for aerosol mounting cup closures and the very competitive pricing of valved mounting cups, it is important that the mounting cups be made as economically as possible and the above enumerated economic losses are undesirable.

A significant portion of the manufacturing costs of the valve mounting cups is the metal of the mounting cup. It is well appreciated by those skilled in the art, that a small saving in the amount of metal in each mounting cup will result in large savings to aerosol valve manufacturers due to the billions of mounting cups produced annually. Therefore, reduction in the thickness of the metal of the mounting cup while maintaining the strength of the mounting cup against the force imposed by the filling head is of economic importance. Conversely, an increase in strength, using the same thickness of metal, is also of great importance from the standpoint of permitting more rapid filling speeds.

The configuration of aerosol mounting cups conventionally used to close aerosol containers, the so-called one (1) inch mounting cups, comprises a raised central or pedestal portion having a central opening to receive a valve stem of the aerosol valve, a profile portion extending radially from the pedestal portion, a body portion extending upwardly from the outer terminus of the profile portion and a skirt portion extending from the body portion for receiving and affixing the mounting cup to the bead of the container.

This invention concerns a modification of the configuration of the profile portion of prior art mounting cups.

In the most common configuration of prior art mounting cups, the profile portion of the mounting cup has a substantially continuous conical profile angle as it extends from the profile portion contiguous to the body portion to the profile portion contiguous to the pedestal portion. In other prior art mounting cups the profile portion has a profile configuration with an upwardly, slightly bowed surface. In still other prior art cups, the profile portion is substantially flat or parallel to the horizontal axis of the cup. In the prior art mounting cups the profile configuration has a similar radius of curvature at the body/profile junction, i.e. the radius at the joinder of the body portion and the profile portion of the mounting cup. It is in this area that the forces generated by the downward motion of the filling head are concentrated.

It has been found that the configuration of the prior art profile portion does not provide the best profile configuration for resisting the force of the filling head during filling of the aerosol container with propellant in the pressure filling system. As a consequence there has been seal rupture during pressure filling. Moreover, due to the inability of the mounting cup to resist the advancing force of the filling head, the manufacturer has been frustrated in its attempts to reduce metal thickness and effect concomitant economies.

SUMMARY OF THE INVENTION

According to the present invention, a mounting cup of the usual type employed to close a conventional aerosol can, the so-called one-inch mounting cup, is strengthened by configuring the terminal end of the profile portion of the mounting cup contiguous to the body portion of the mounting cup with an "S"-like shaped segment. The "S"-like shape is that segment of the profile portion of the mounting cup that lies between the point of tangency of a radius to the body portion (hereafter and in the drawings designated as Radius R1) and the point of tangency of a radius to the underside of the profile portion distal to the body portion (hereafter Radius R2). The "S"-like shaped segment, as defined above, is configured such that a tangent to the upper surface of the section of the "S"-shaped segment distal to the body portion of the mounting cup forms a substantially reduced angle (Angle A) with a vertical line parallel to the vertical axis of the mounting cup than does the prior art configurations. That is, the angle formed by a tangent to the above-noted distal section of the "S"-like segment and a line parallel to the vertical axis of the mounting cup is less in the configuration of the subject invention than in the indicated prior art. The reduction in Angle A is achieved by increasing the depth of the section of the "S"-like shaped segment contiguous to the body portion (hereafter Panel Depth). Additionally, the more vertical the segment of the profile portion that joins to the radially inward portion of the "S"-like shape segment of the profile portion, the greater the strength of the mounting cup.

It should be understood, however, that there are inherent restrictions to varying the values of Angle A and Angle B that are dictated by the size of the pedestal portion diameter. For example, in different one (1) inch mounting cups, the distance between the outside diameter of the pedestal and the inside diameter of the body may vary and further the distance between the bottom of the mounting cup and the bottom of the pedestal portion may vary. These variances restrict the size of Angle A and Angle B that may be accommodated.

In general, as the distance between the bottom of the cup and the bottom of the pedestal more nearly approaches, or exceeds, the distance between the outside diameter of the pedestal portion and the inner diameter of the body portion, the more vertical both Angle A and Angle B. In sum, and within the limits described hereafter, the more parallel the tangent to the distal section of the "S" segment is to a line parallel to the body portion of the mounting cup, the greater the strength of the mounting cup to resist the force applied by the advancing filling head.

Further caveats of the subject invention are the following:

1. The position of critical stress is at the radius of curvature formed by the body portion of the mounting cup and the profile portion of the mounting cup. This portion has been marked with an asterisk in FIG. 4.

2. The shorter the distance between the body inside diameter and the outer diameter of the side-wall of the pedestal, the stronger the resistance to deformation of the mounting cup during advancement of the filling head. However, it should be understood that the distance between the upright wall of the pedestal portion and the upright wall of the body portion may not be so narrowed that it is impossible to have the tool that clinches the mounting cup to the bead of the container enter the space between the body portion and the pedestal portion. Also, disposing the "S"-like shape more remote from the body portion causes the portion of the "S"-like shape distal to the body portion to have a slope moving from the vertical and toward the horizontal axis of the mounting cup; and thus, working against the desiderata of having the tangent to the distal section of the "S"-like shape as parallel as possible to a line parallel to the upright body portion.

3. There is a limit to effecting the enhancement of the resistance to deformation of the mounting cup by the downward force applied to the pedestal by the advancing filler head through increasing the Panel Depth that creates and defines the "S"-like shaped segment contiguous to the body portion. For a given material of construction, having a given thickness, exceeding the optimum Panel Depth will reduce Angle B shown in FIG. 4, relative to the horizontal axis of the mounting cup, thereby flattening the cup profile and weakening the cup structure.

A particular advantage of the present invention is its applicability to conventional aerosol mounting cups without the necessity of making radical changes in the configuration and dimensioning of existing mounting cups, as well as, avoiding any substantial change in the construction or configuration of the filling head.

Accordingly, it is an object of the present invention to provide an aerosol mounting cup for use with a pressure filling system for injecting propellant into the aerosol container that has an improved resistance to deformation caused by the force encountered by the advancing filling head during propellant filling. Other objects and advantages to the subject mounting cup will be obvious to a man skilled in the art upon a study of the subject description of the invention.

It is a still further object and advantage of this invention to provide a mounting cup configuration that will permit the use of a thinner gauge of metal in the mounting cup.

BRIEF DESCRIPTION OF THE DRAWINGS

FIG. 4 is an enlarged view of the circled portion of FIG. 3.

FIG. 5 is a cross-sectional view of a female sizing die that may be used to form the "S"-shaped configuration of the mounting cup of this invention.

FIG. 6 is an enlarged view of the circled portion of the sizing die of FIG. 5.

FIG. 7 is the male punch for the sizing die of FIG. 6.

DETAILED DESCRIPTION

Figure 1:
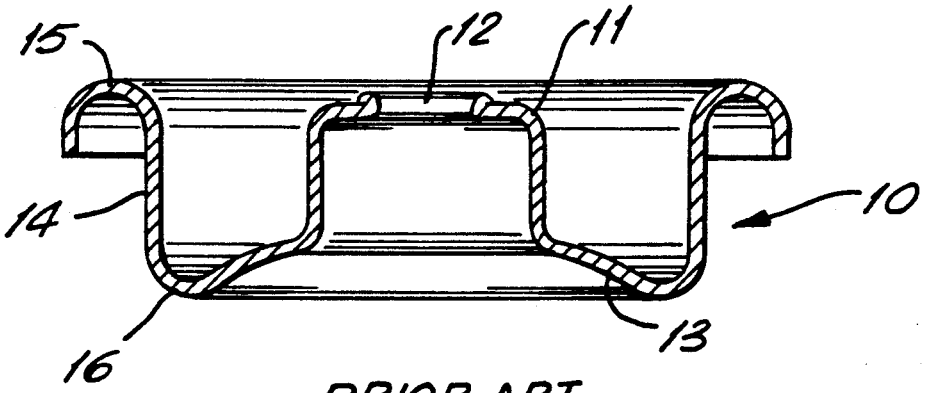
PRIOR ART FIG. 1
FIGS. 1 and 2 are cross-sectional views of some embodiments of mounting cups of the prior art.

In FIG. 1, there is generally shown a prior art mounting cup 10, having a pedestal portion 11, with a central opening 12, a profile portion 13 emerging radially from the pedestal portion 11, and a body portion 14 terminating in a skirt portion 15, which skirt portion is shaped to receive the bead (not shown) of a conventional aerosol container having a one (1) inch opening (not shown). In this mounting cup configuration, the area 16 is the zone of critical stress.

Figure 2:
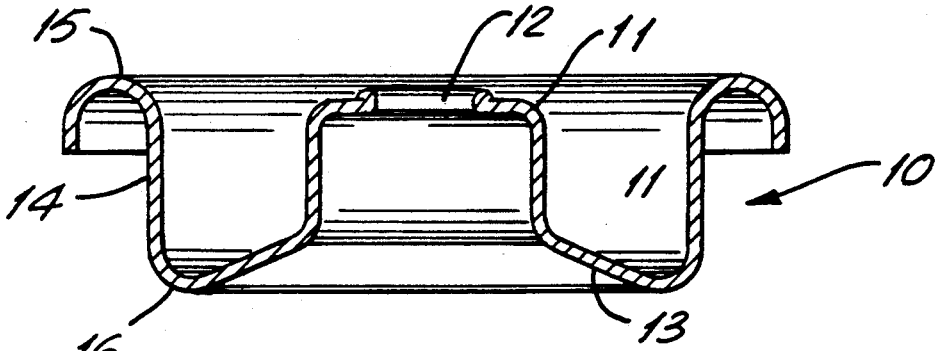
PRIOR ART FIG. 2

FIG. 2 likewise is a prior art mounting cup configuration having corresponding components as in FIG. 1, except that in FIG. 2 the slope of the profile portion is more nearly the same throughout the length of the profile portion; in contrast to the slope of the profile portion of FIG. 1, wherein the slope is more dome-like.

Figure 3:
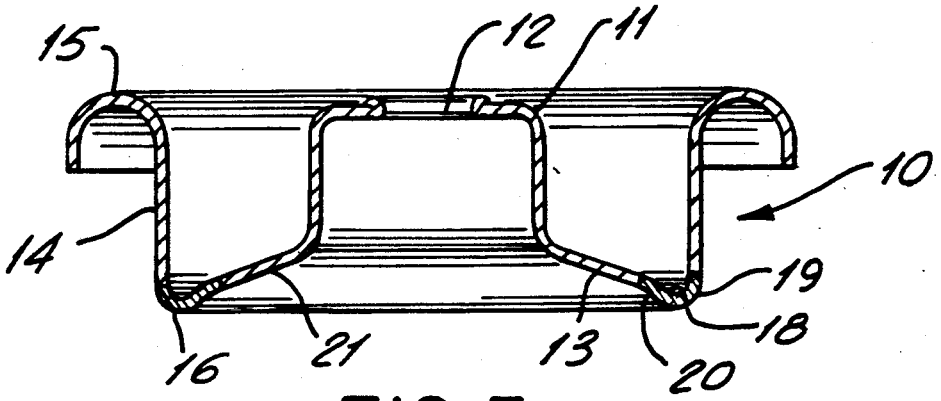
FIG. 3 is a cross-sectional view of the mounting cup of this invention.

In FIG. 3, the components of the structure of the mounting cup are similarly designated as in FIGS. 1 and 2. As shown in FIG. 3 and in the enlarged detail of FIG. 4, the terminal end of the profile portion 13 of the mounting cup 10 contiguous to the body portion 14 has an "S"- like shaped segment 18, which "S"-like shaped segment 18 has a component 19 that merges with the body portion 14 and a component 20 which is distal to the body portion 14 that merges with the constant slope segment 21 of the profile portion 13.

Through testing, it has been found that the critical concentration of stress is at the radius marked with a single asterisk in FIGS. 3–4. Also, it has been found that with a steel mounting cup having a thickness of 0.010–0.011 inches, that providing an "S"-like shaped segment having a Panel Depth of 0.015–0.040" improved the resistance to the forces of the advancing filling head.

As shown in Table I below, the greatest improvement in resisting deformation was achieved at a Panel Depth of 0.030" at which the tangent/vertical axis angle (Angle A) is approximately 30°. Angle B is approximately 20°. The thickness of the mounting cup in Table I is 0.10"–0.011" and the mounting cup composition is steel.

TABLE I

| LOADING WEIGHT | | | | | | | |
|---|---|---|---|---|---|---|---|
| P: (BAR) | 3.4 | 3.5 | 3.6 | 3.7 | 3.8 | 3.9 | 4.0 |
| F: KILOGRAM ON PEDESTAL | 60.5 | 62.25 | 64 | 65.75 | 67.5 | 69.25 | 71 |
| PRIOR ART CUPS (GOLD EPOXY ON BOTH SIDES) | | | | | | | |
| PRIOR ART CUPS OF FIGS. 1 OR 2 | 100% | | | | | | |
| DESIGN OF SUBJECT INVENTION | | | | | | | |
| .015 PANEL DEPTH | | 100% | | | | | |
| .020 PANEL DEPTH | | | | | 100% | | |
| .030 PANEL DEPTH | | | | | | | 100% |
| .040 PANEL DEPTH | | | | | | 100% | |

It should also be understood that the optimum configuration of the "S"-like shaped segment, as defined by the Panel Depth and the Angles A and B, will vary depending on the thickness of the metal, the nature of any coating on the mounting cup, the nature of the metal and the distance between the inside diameter of the body portion of the mounting cup and the outside diameter of the pedestal portion of the mounting cup.

The process for forming the mounting cup of this invention is well within the skill of an artisan familiar with metal forming or aerosol mounting cup manufacture.

FIG. 5 is a drawing of the sizing die that may be used to form a 0.030" Panel Depth in the mounting cup of the subject invention. FIG. 7 is the male punch that mates with the die shown in FIGS. 5 and 6.

It should be understood that the composition of the mounting cup herein may be steel, aluminum, plastic or other structurally formable materials, including laminated metals, plastic or other formable materials. Data to date has shown an improvement against top load deformation when the mounting cup was formed of approximately 0.016" thick aluminum and a Panel Depth of 0.030". Also, tests show that steel laminated with plastic having a 0.010"–0.011" thickness showed comparable results to the 0.030" Panel Depth reported in Table I.

It will be understood that various changes an modifications can be made in the details of construction and use without departing from the spirit of the invention, especially as defined in the following claims.

What is claimed is:

1. In an improved mounting cup for use in a pressure filling system, said mounting cup comprising a pedestal portion, a profile portion and a body portion terminating in a skirt that receives and seals with the bead of an aerosol container; said profile portion joined at one end with the pedestal portion and at its other end with the body portion, the improvement which comprises forming an annular "S"-like shaped segment in the profile portion, said "S"-like shaped segment comprising a section contiguous to the body portion and a section distal to the body portion, the section of the "S"-like shaped segment contiguous to the body portion being disposed a greater distance from the top of the body portion than the section of the "S"-like shaped segment distal to the body portion, thereby creating a panel depth in the "S"-like shaped segment contiguous to the body portion.

2. The improved mounting cup of claim 1, and further wherein the mounting cup is of a metallic composition.

3. The improved mounting cup of claim 2, and further wherein the composition of the metallic mounting cup is selected from the group consisting of steel, aluminum, steel with laminated plastic or aluminum with laminated plastic.

4. The improved mounting cup of claim 2, and further wherein the panel depth is approximately 0.030".

5. The improved mounting cup of claim 2, and further wherein the panel depth is approximately 0.030" and the composition of the mounting cup is steel and the thickness of the steel is approximately 0.010–0.011".

6. The improved mounting cup of claim 3, and further wherein the panel depth is approximately 0.015"–0.040".

7. The improved mounting cup of claim 1, and further wherein the profile portion other than the "S"-like shaped segment thereof is upwardly conically shaped from the terminal end of the "S"-like shaped segment distal to the body portion to the pedestal portion.

8. The mounting cup of claim 7, and further wherein the mounting cup is of a metallic composition.

9. The mounting cup of claim 7, and further wherein the composition of the metallic mounting cup is selected from the group consisting of steel, aluminum, plastic laminated steel or plastic laminated aluminum.

10. The improved mounting cup of claim 7, and further wherein the slope of the upwardly conically shaped segment of the profile portion of the mounting cup is approximately 20° from the horizontal axis of the mounting cup.

11. The improved mounting cup of claim 10, and further wherein the panel depth is approximately 0.030".

* * * * *